US005503117A

United States Patent [19]

Saito

[11] Patent Number: 5,503,117

[45] Date of Patent: Apr. 2, 1996

[54] ENGINE COOLING SYSTEM

[75] Inventor: Tetsushi Saito, Iwata, Japan

[73] Assignee: Yamaha Hatsudoki Kabushiki Kaisha, Iwata, Japan

[21] Appl. No.: 331,052

[22] Filed: Oct. 28, 1994

[30] Foreign Application Priority Data

| | | | |
|---|---|---|---|
| Oct. 29, 1993 | [JP] | Japan | 5-294117 |
| Oct. 29, 1993 | [JP] | Japan | 5-294118 |
| Oct. 29, 1993 | [JP] | Japan | 5-294119 |

[51] Int. Cl.[6] ..... F01P 5/10

[52] U.S. Cl. ..... 123/41.44; 123/41.01; 123/195 C; 123/196 AB

[58] Field of Search ..... 123/41.01, 41.44, 123/41.47, 195 C, 196 AB

[56] References Cited

U.S. PATENT DOCUMENTS

| | | | |
|---|---|---|---|
| 2,063,436 | 12/1936 | Hild | 123/196 AB |
| 2,852,009 | 9/1958 | Turlay | 123/41.1 |
| 4,155,333 | 5/1979 | Maggiorana | 123/41.44 |
| 5,000,142 | 3/1991 | Aruga et al. | 123/195 C |
| 5,074,255 | 12/1991 | Ebesu et al. | 123/195 C |
| 5,148,784 | 9/1992 | Hiraoka et al. | 123/195 C |

FOREIGN PATENT DOCUMENTS

| | | |
|---|---|---|
| 960326 | 3/1957 | Germany . |
| 4211896 | 10/1993 | Germany . |
| 2231087 | 7/1990 | United Kingdom . |

*Primary Examiner*—Noah P. Kamen
*Attorney, Agent, or Firm*—Knobbe, Martens, Olson & Bear

[57] ABSTRACT

A number of embodiments of engine construction having chain-driven overhead camshafts closed by a timing case cover and which timing case cover forms at least in part a coolant pump to the engine. Various arrangement for circulating the liquid coolant through the engine and an oil cooler mounted at the base of the engine are disclosed.

19 Claims, 10 Drawing Sheets

ENGINE COOLING SYSTEM

BACKGROUND OF THE INVENTION

This invention relates to an engine cooling system and more particularly to an improved coolant pump and coolant circulation system for a liquid cooled internal combustion engine.

As is well known, liquid cooled internal combustion engines have cooling jackets formed in their cylinder block and/or cylinder head through which liquid coolant, normally water or a mixture of water and antifreeze, are circulated. Generally, the coolant pump is mounted on an external face of the engine and is driven from the engine crankshaft for circulating the liquid coolant. In addition to the coolant pump, a number of other accessories for the engine are driven by the crankshaft, and these may include one or more camshafts, an alternator or generator, power steering pumps, air conditioning compressors, vacuum pumps, and a wide variety of other components. These accessories are driven by one or more flexible transmitters, which may include both chains and/or belts. Normally, the coolant pump is mounted on the end of the engine where the other accessories are driven, and this gives rise to certain difficulties.

For example, it is desirable to place the water pump so that it can be mounted directly on one of the major engine castings so as to minimize the number of external coolant conduits. However, the coolant pump should also be mounted in such a location that it can be easily serviced. This means that the coolant pump is generally positioned on the outside of the timing case that contains the driving mechanism for the camshafts for the engine. This obviously makes it difficult to mount the water pump in direct relationship to the cooling passages of the cylinder block or cylinder head.

Also, it is desirable to mount the various components that are driven in such a way that all or many of them can be driven by a single flexible transmitter. This necessitates positioning of the pulleys on the drive shafts for the various accessories in the same plane. This is very difficult with the type of engine constructions previously employed.

Frequently, in addition to the engine being liquid cooled, there is provided a heat exchanger for cooling the lubricating oil. It is desirable if this heat exchanger can be cooled by the same coolant that is circulated through the engine. This adds to the number of external conduits which must be employed with the previous types of construction, and gives rise to the possibility of leaks and further complicates the driving arrangement for the system.

It is, therefore, a principal object of this invention to provide an improved arrangement for mounting and driving the coolant pump of a liquid cooled internal combustion engine.

It is a further object of this invention to provide an improved and compact liquid coolant pump for an internal combustion engine that minimizes the number of external components and which permits all accessories to be driven by a single flexible transmitter.

SUMMARY OF THE INVENTION

This invention is adapted to be embodied in an internal combustion engine that is comprised of a cylinder block having an end face. A crankshaft is journaled for rotation at a lower portion of the cylinder block and a camshaft is journaled for rotation at an upper portion of the cylinder block. Timing means are disposed forwardly of the engine block end face for driving the camshaft from the crankshaft. A timing case cover is affixed to the cylinder block and encloses at least in part the end face and at least a part of the timing means. A coolant pump assembly for circulating liquid coolant for the engine is formed at least in part in the timing case cover.

DETAILED DESCRIPTION OF THE PREFERRED EMBODIMENTS OF THE INVENTION

Figure 1:
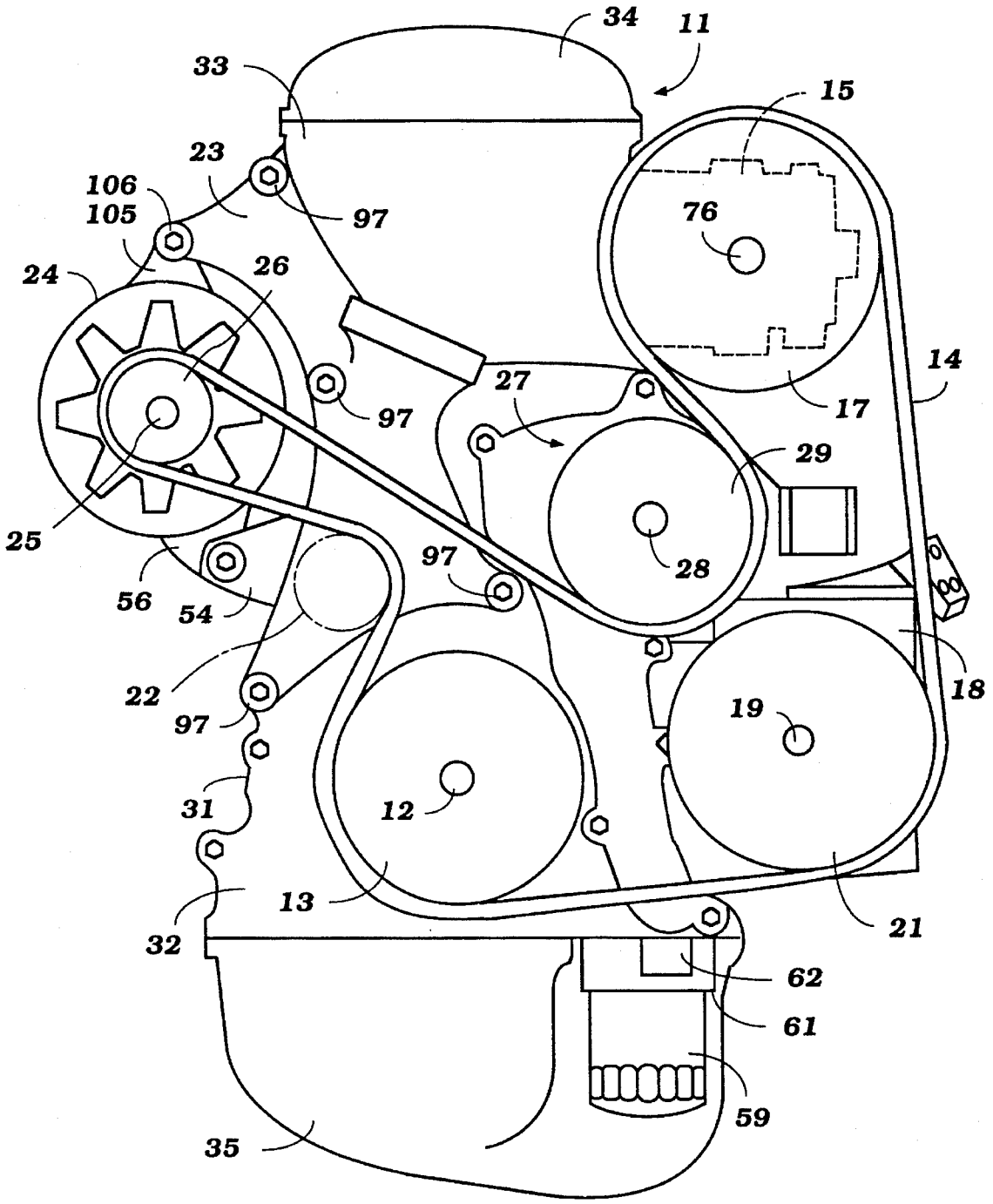
FIG. 1 is a front elevational view of a liquid cooled internal combustion engine constructed in accordance with a first embodiment of the invention.

Referring now in detail to the drawings and initially to FIG. 1, an internal combustion engine constructed in accordance with a first embodiment of the invention is shown in front elevational view and is identified generally by the reference numeral 11. In the illustrated embodiment, the engine 11 is of the four cycle, multiple cylinder in-line type. Although the invention is described in conjunction with an in-line type of engine, it will be readily apparent to those skilled in the art how the invention may be applied to a V-type engine. Generally, the construction as illustrated would be applied to one bank of such a V-type engine, although other applications to V-type engines are possible. The particular number of cylinders employed for the engine 11 is not an important feature of the invention, but it should be noted that the engine 11 is liquid cooled.

As may be seen in FIG. 1, the engine 11 has a crankshaft 12 that extends through the front portion of the body of the engine and which is journaled in the engine in a well known manner. A drive pulley 13 is affixed to the exposed end of the crankshaft 12 and drives a drive belt 14 which, in turn, drives a number of engine accessories. These engine accessories are comprised of a power steering pump 15 that has a drive shaft 16 to which a pulley 17 is affixed. The pulley 17 is driven by the drive belt 14. In addition, an air conditioning compressor 18 is mounted on the same side of the engine 11 as the power steering pump 15 and has a drive shaft 19 to which a pulley 21 is affixed. The pulley 21 is also driven by the drive belt 14.

An idler pulley, shown in phantom and identified by the reference numeral 22, is mounted on the opposite side of the engine, for example, on an alternator mounting bracket 23, and engages the drive belt 14 to maintain it in engagement with the crankshaft pulley 13. An alternator or generator, indicated generally by the reference numeral 24, is mounted on the alternator bracket 23 in a manner which will be described, and has an alternator shaft 25. A pulley 26 is affixed to the alternator shaft and is also driven by the drive belt 14.

A water pump assembly, indicated generally by the reference numeral 27 and formed in accordance with a feature of the invention, is mounted on the front face of the engine 11 in a manner which will be described. This water pump 27 has an impeller shaft 28 to which a pulley 29 is affixed. The pulley 29 is also driven by the drive belt 14.

In order to permit the single drive belt 14 to drive all of the described accessories, it is necessary that their respective pulleys 17, 21, 26 and 29, as well as the idler pulley 22 and the crankshaft pulley 13, to lie in a common plane. The layout of the components of the engine, as will be described, permits this to be achieved.

Figure 2:
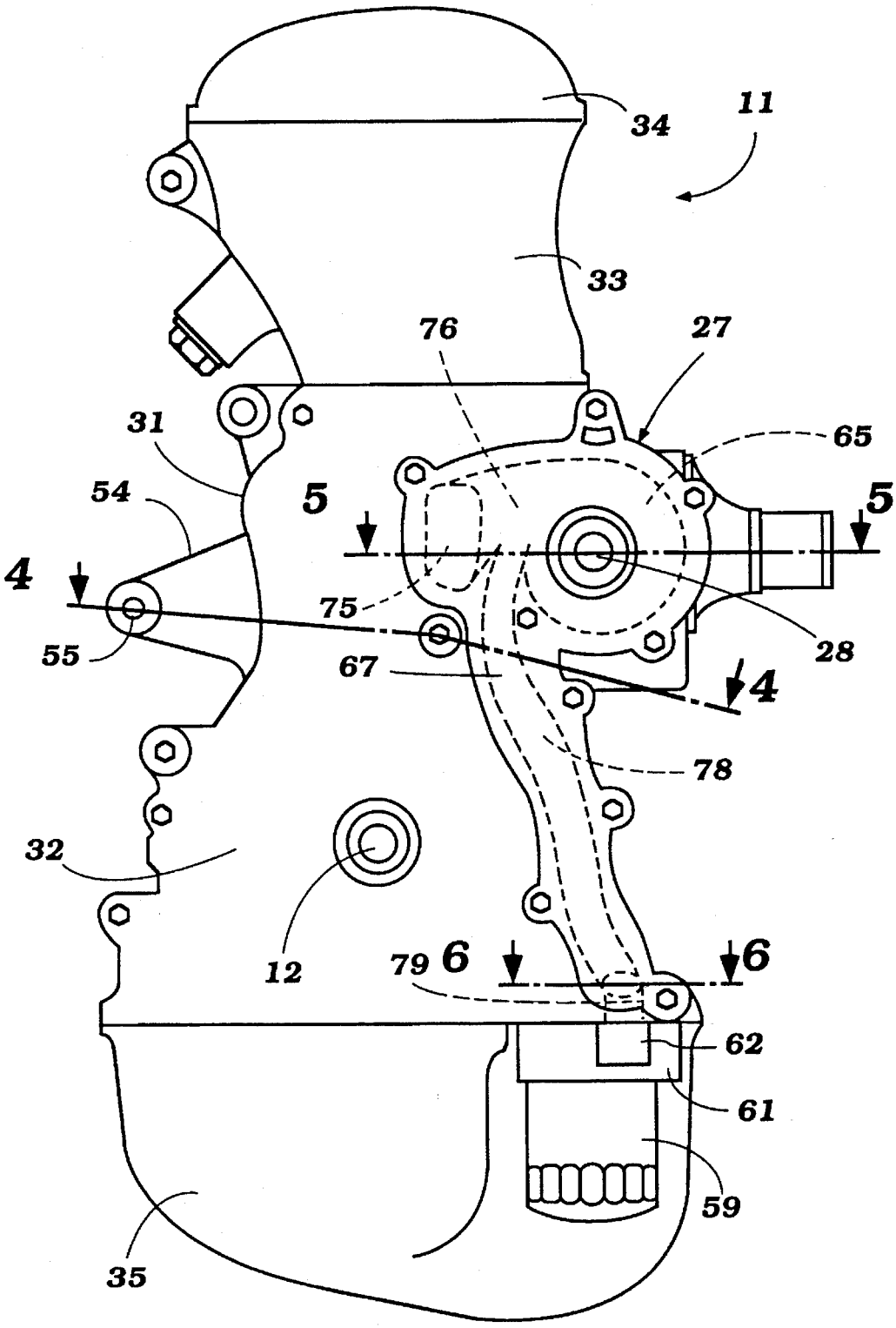
FIG. 2 is a front elevational view, in part similar to FIG. 1, but shows the belt driven engine accessories removed, except for the water pump.

Referring now additionally to FIG. 2, which is a view showing all of the engine driven accessories driven by the belt 14 removed, except for the water pump 27, but the drive pulley 29 of the water pump 27 is removed. In addition, the alternator mounting bracket 23 is removed. It will be seen that the engine 11 is comprised of two major castings, one of which comprises a cylinder block 31 having a front face which is enclosed by a timing chain cover 32 in a manner which will be described. A cylinder head casting 33 is affixed to the cylinder block 31 in a known manner. The cylinder block 32 and cylinder head 33 have internal cooling jackets which may have generally any known configuration, and only a portion of the cylinder block cooling jacket will be described later.

The lower end of the cylinder block 31 is enclosed by a crankcase member 35 that is affixed to it and which contains the crankshaft 12 and contains lubricant for the engine 11.

As will become apparent, the engine 11 is of the twin overhead cam type, and the cylinder head 33 mounts a pair of camshafts which are enclosed by a cam cover 34 that is affixed to the cylinder block 33 in a well known manner. This camshaft arrangement and the drive therefor will now be described by reference to FIG. 3, which is a view similar to that of FIG. 2, but in this view, the timing chain cover 32 has been removed, along with the water pump 27, which is formed integrally with it in a manner which will be described.

The cylinder head 33 has a 5-valve-per-cylinder arrangement, including 3 intake valves for each cylinder of the engine which are formed on one side of the cylinder head 33, the left-hand side as seen in the Figures. These intake valves are all operated directly by an overhead mounted intake camshaft 36 that is journaled in a known manner in the cylinder head 33. On the other side of the cylinder head 33, there are provided a pair of exhaust valves (not shown) for each cylinder which are operated by an exhaust camshaft 37, which is also rotatably journaled in the cylinder head 33 in a well known manner.

The intake and exhaust valves may be supported in an orientation of the type disclosed in U.S. Pat. No. 4,660,529, issued Apr. 28, 1987 in the name of Masaaki Yoshikawa, entitled "Four-Cycle Engine", now reissued as RE 33787, and which patent and reissue are assigned to the assignee hereof. It will be noted that the exhaust camshaft 37 lies closer to the center of the cylinder bore than the intake camshaft 36. Said another way, the intake camshaft 36 is offset outwardly toward one side of the cylinder head 33 more than the exhaust camshaft 37.

The camshafts 36 and 37 are driven in timed relationship relative to the crankshaft 12 at one-half crankshaft speed, as is well known in this art. This timing drive, in the illustrated embodiment, is of the two-stage type and includes a first timing chain 38 which is driven by a sprocket 39 affixed to the crankshaft 12 and within a timing case 41 formed in part by a front face 42 of the cylinder block 31. This timing chain 38 drives a cam driving shaft 43 which is journaled in the cylinder head 33 in a suitable manner and which cam driving shaft 43 is disposed to one side of the cylinder head 33. That is, it is offset closer to the exhaust camshaft 37 than to the intake camshaft 36. A two-stage sprocket 44 is affixed to the cam driving shaft 43, and its larger diameter portion is driven by the timing chain 38.

The smaller diameter portion of the two-stage sprocket 44 is engaged with a second timing chain 45 which, in turn, engages sprockets 46 and 47 affixed to the intake and exhaust camshafts 36 and 37, respectively, so as to drive them. The 2 to 1 speed reduction between the crankshaft 12 and the camshafts 36 and 37 may be derived in any proportion between the sprocket 39, two-stage sprocket 44, and the camshaft sprockets 46 and 47.

Figure 3:
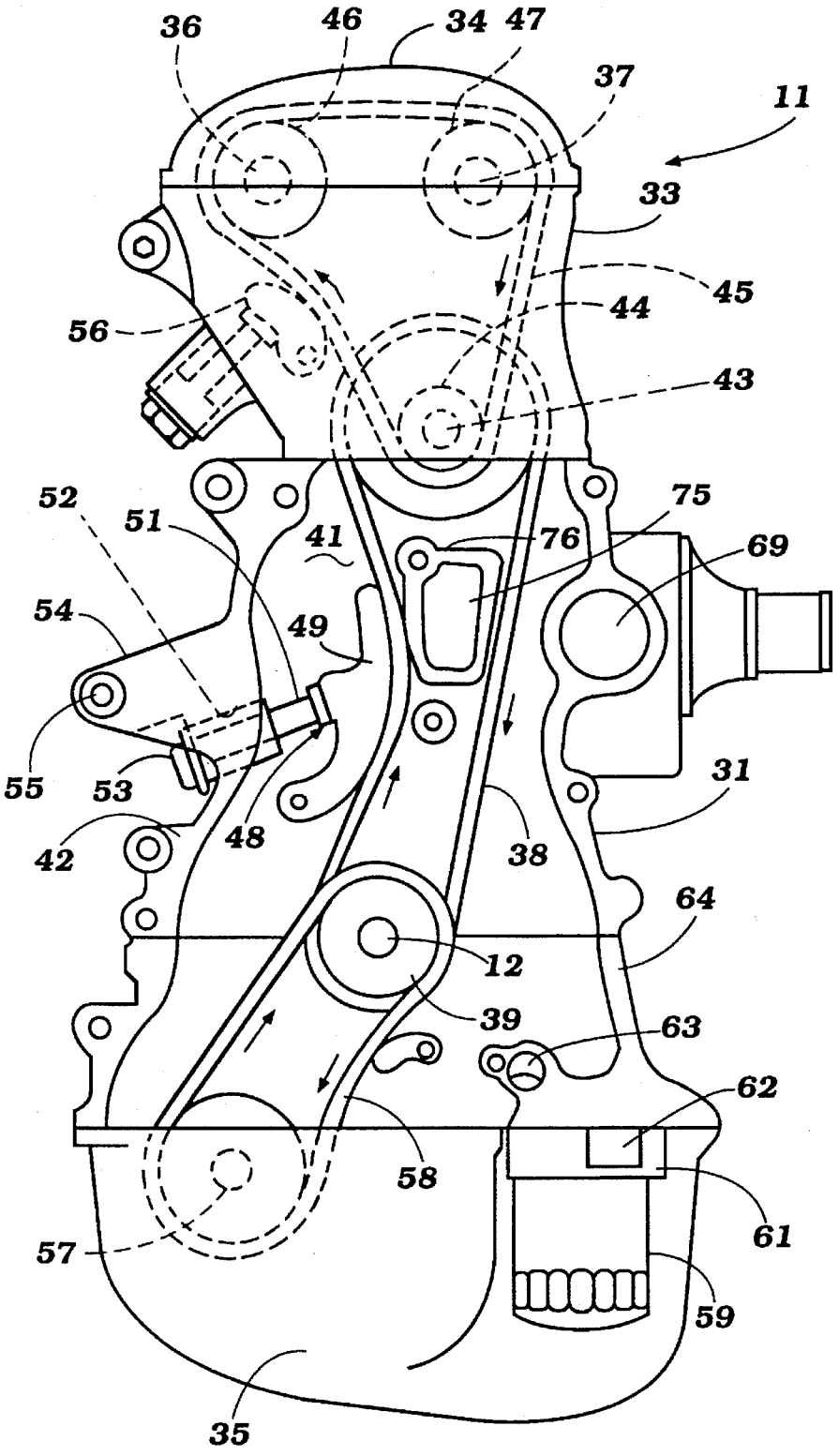
FIG. 3 is a front elevational view, in part similar to FIGS. 1 and 2, and shows the timing case cover also removed.
Figure 4:
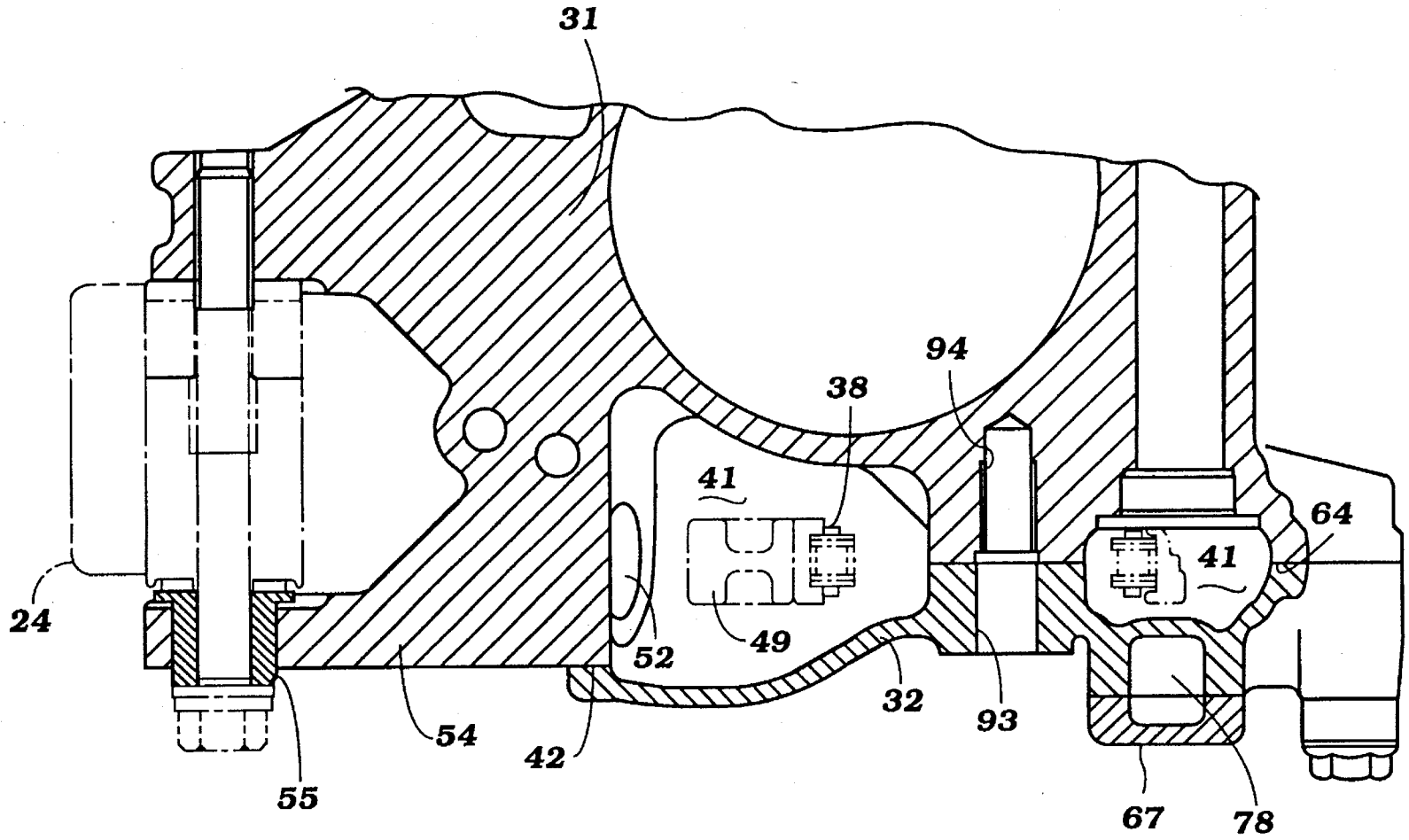
FIG. 4 is an enlarged cross-sectional view taken along the line 4—4 of FIG. 2.

Because the cam driving shaft 43 is offset to one side of the cylinder head 33 and cylinder block 31, it is possible to provide a chain tensioner, indicated generally by the reference numeral 48, on the other side of the timing case 41, as seen in FIGS. 3 and 4. This chain tensioner 48 includes a shoe 49 that is engaged with the slack or return side of the timing belt 38 and which is affixed on a port 51 that extends into a cavity 52 formed in the cylinder block 31 at one side thereof. A coil compression spring places a force on the tensioner shoe 49 and the post 51 is locked in place by a retainer nut 53 so as to maintain the desired tension on the chain 38, as is well known in this art.

The cylinder block opening 52 in which the tensioner mechanism 48 is received is formed adjacent a boss 54 formed on this side of the cylinder block and which receives a mounting post 55 for mounting a lug 56 (FIG. 1) of the alternator assembly 24. The remaining mount for the alternator assembly 24 will be described later.

The offsetting of the cam driving shaft 43 also permits the positioning of a tensioner assembly 56 on the side of the cylinder head assembly 33 adjacent the intake camshaft 36. This tensioner assembly 56 has the same general construction as that associated with the timing chain 38 (tensioner 48), and further description of it is not believed to be necessary.

As has been noted, the engine 11 is provided with a lubricating system, and this includes lubricant which is contained within the oil pan 35. An oil pump having a pump drive shaft 57 is contained within the oil pan 35 and is driven by a chain 58 which is, in turn, driven by the crankshaft sprocket 39. Lubricant is circulated in a known manner through the engine lubricating system, and this system includes an oil filter 59 that is surrounded by an oil cooling jacket 61 having a coolant inlet boss 62 to which engine coolant is delivered, in a manner which will be described in conjunction with the description of the cooling system for the engine, including the water pump 27.

The lubricant pump delivers lubricant to the oil cooler 61 and oil filter 59 through an inlet fitting 63 formed in a front face of a flange 64 of the lower portion of the cylinder block 31. Lubricant that has then passed through the oil filter 59 is delivered to the various components of the engine to be lubricated, in any known manner. Basically, except for the water pump and its relationship to the camshaft drive and the other accessory drive and the oil cooler 61, the engine may be of any conventional type. However, the 5-valve-per-cylinder arrangement previously described is a preferred form of the invention.

As may be best seen in FIG. 4, the front faces 42 and 64 are formed by flanges on opposite sides of the timing case 41 are staggered relative to each other. That is, the face 42 lies in a plane that is parallel to but spaced further forwardly than the face 64. The reason for this is to accommodate the water pump structure and to have the driving pulley 29 for the water pump 27 to be disposed in the same plan as the drive pulleys 13, 17, 21 and 26.

Figure 5:
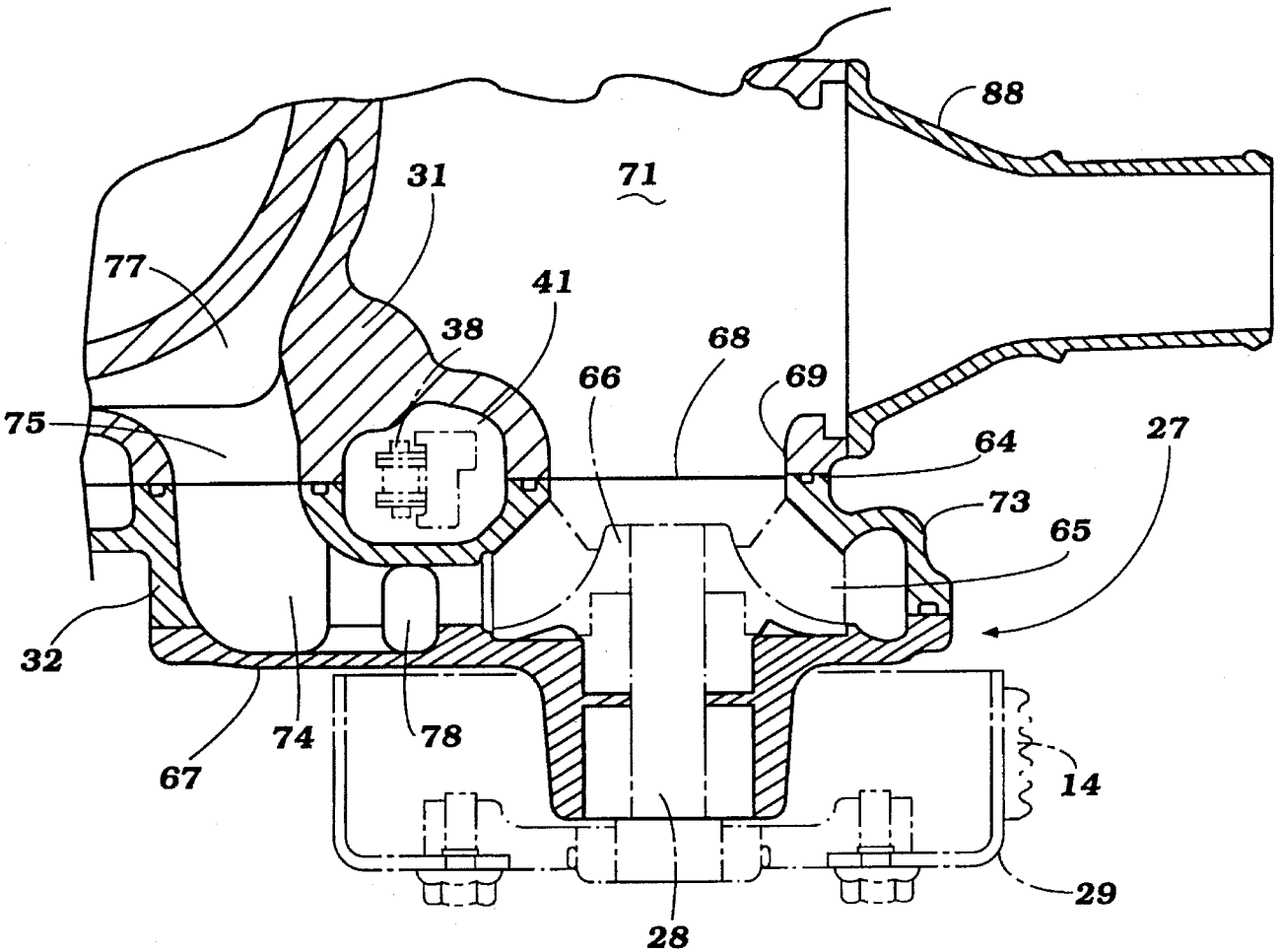
FIG. 5 is an enlarged cross-sectional view taken along the line 5—5 of FIG. 2 and shows the water pump drive pulley and impeller in phantom.
Figure 6:
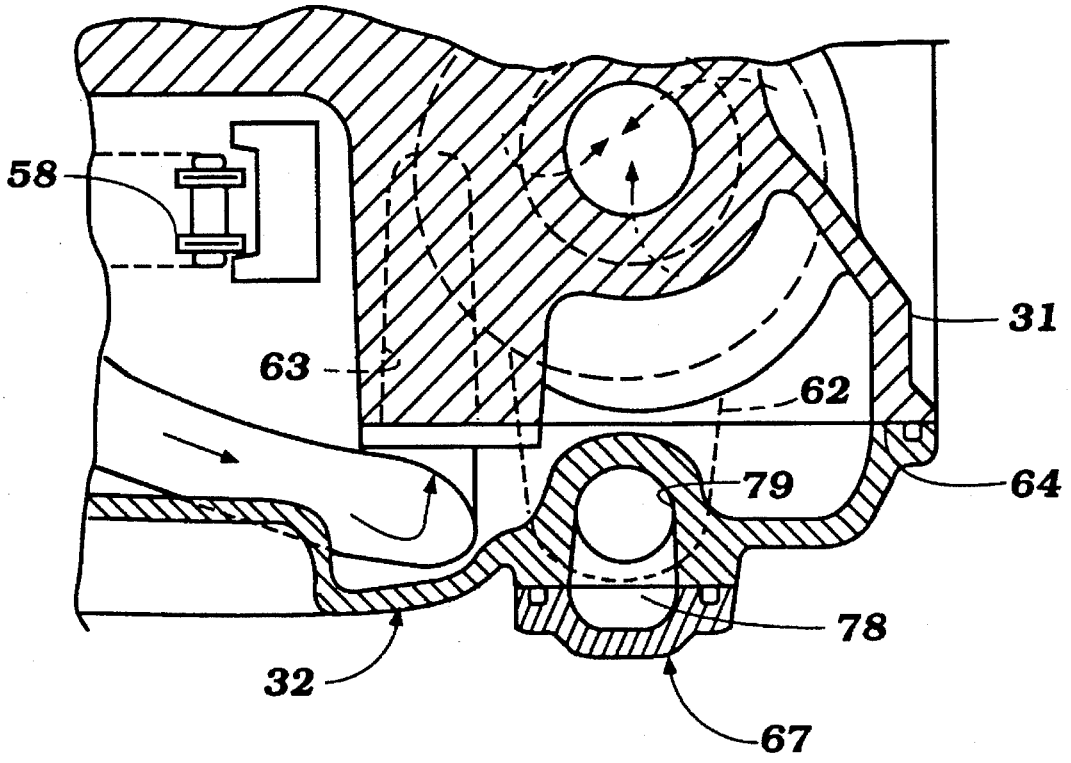
FIG. 6 is an enlarged cross-sectional view taken along the line 6—6 of FIG. 2.
Figure 7:
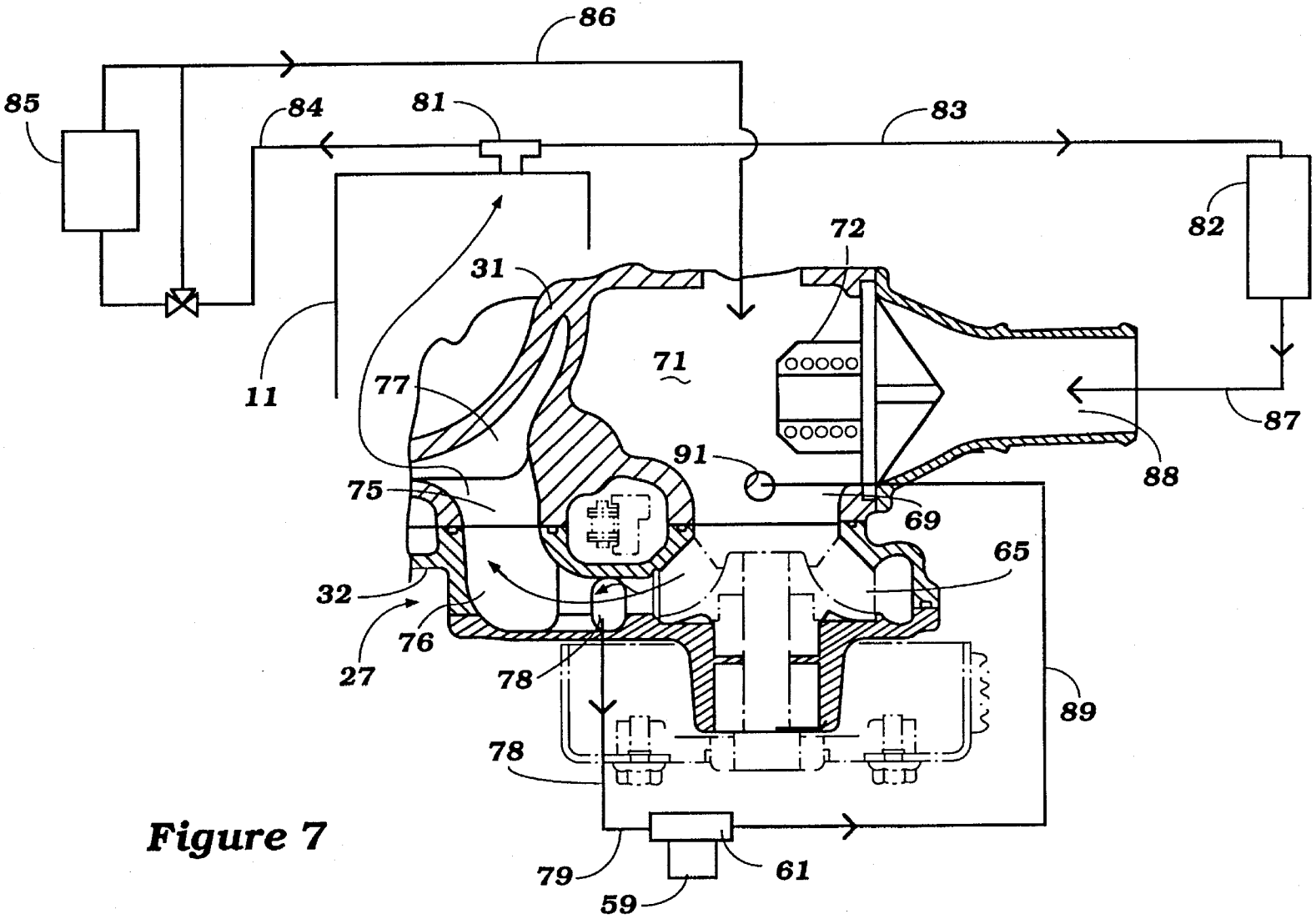
FIG. 7 is a view, in part similar to FIG. 5, but shows the remaining components of the liquid cooling system for the engine in schematic fashion.

Referring now primarily to FIGS. 5 and 7, it will be seen that the timing case cover 32 is provided with a cavity 65 that receives an impeller 66 of the coolant pump assembly 27. A coolant pump cover piece 67 is affixed to the timing case cover 32 in an appropriate manner, and provides a journal for the impeller shaft 28 of the coolant pump 27. The rear of the timing case cover 32 is provided with an opening 68 which meets with a corresponding opening 69 (see also FIG. 3) formed in the front of the cylinder block 31 in its face 64 on the outer side of the timing case 41. This opening 69 communicates with a thermostat cavity 71 in which a thermostat assembly 72 is provided. The flow of coolant through the engine will be described later by reference to FIG. 7.

When the impeller 66 is driven by the drive belt 14, coolant will be drawn from the chamber 71 through the openings 69 and 68 and discharged through a scroll portion formed in a protuberance 73 of the timing case cover 32 to a discharge passageway 74 that is formed by the timing case cover 32 and the water pump cover 67. A portion of this coolant will be delivered to the engine cooling jacket through a coolant inlet opening 75 formed in the front face of the cylinder block 31 (see also FIG. 3). It will be seen that this cylinder block opening 75 is positioned in the timing case portion 41 and is surrounded by the timing chain 38. A flange 76 extends outwardly in sealing relationship with the timing case 32 so as to ensure against coolant leakage.

From the inlet opening 75, coolant flows to the cylinder block cooling jacket, which appears partially in FIGS. 5 and 7 and which is identified by the reference numeral 77. The remaining flow of the coolant will be described later by reference to FIG. 7.

The coolant pump cover 67 and timing case cover 32 form a further coolant passageway 78 (FIGS. 2, 4 and 5) that extends from the passageway 74 downwardly along the front of the engine to a discharge opening that communicates with a passageway 79 formed in the cylinder block 31 and which terminates in the water inlet opening boss 62 of the oil cooler 61.

The coolant flow path will now be described by reference to FIG. 7. As has been noted, the coolant pumped by the coolant pump 27 is delivered to the cylinder block cooling jacket 77 through the inlet 75. This coolant then circulates through the remainder of the cooling jackets of the engine 11 and is discharged through a discharge fitting 81 which communicates with the heat exchanger or radiator 82 through a conduit shown schematically at 83. In addition, a branch passage 84 extends to a heater core 85 of the heating/air conditioning system of the vehicle and this coolant is returned to the cylinder block thermostat cavity 71 through a return conduit 86.

Coolant from the radiator 82 will flow into the thermostat cavity 71 when the thermostat 72 is opened through a conduit 87 that communicates with a thermostat housing 88 that is affixed to the cylinder block 31 in a well-known manner. The coolant from the oil cooler 61 is returned also to the thermostat cavity 71 of the cylinder block 31 through a conduit shown schematically at 89 and which terminates in a port 91 formed in the cylinder block 31 and which communicates with the cavity 72.

Figure 8:
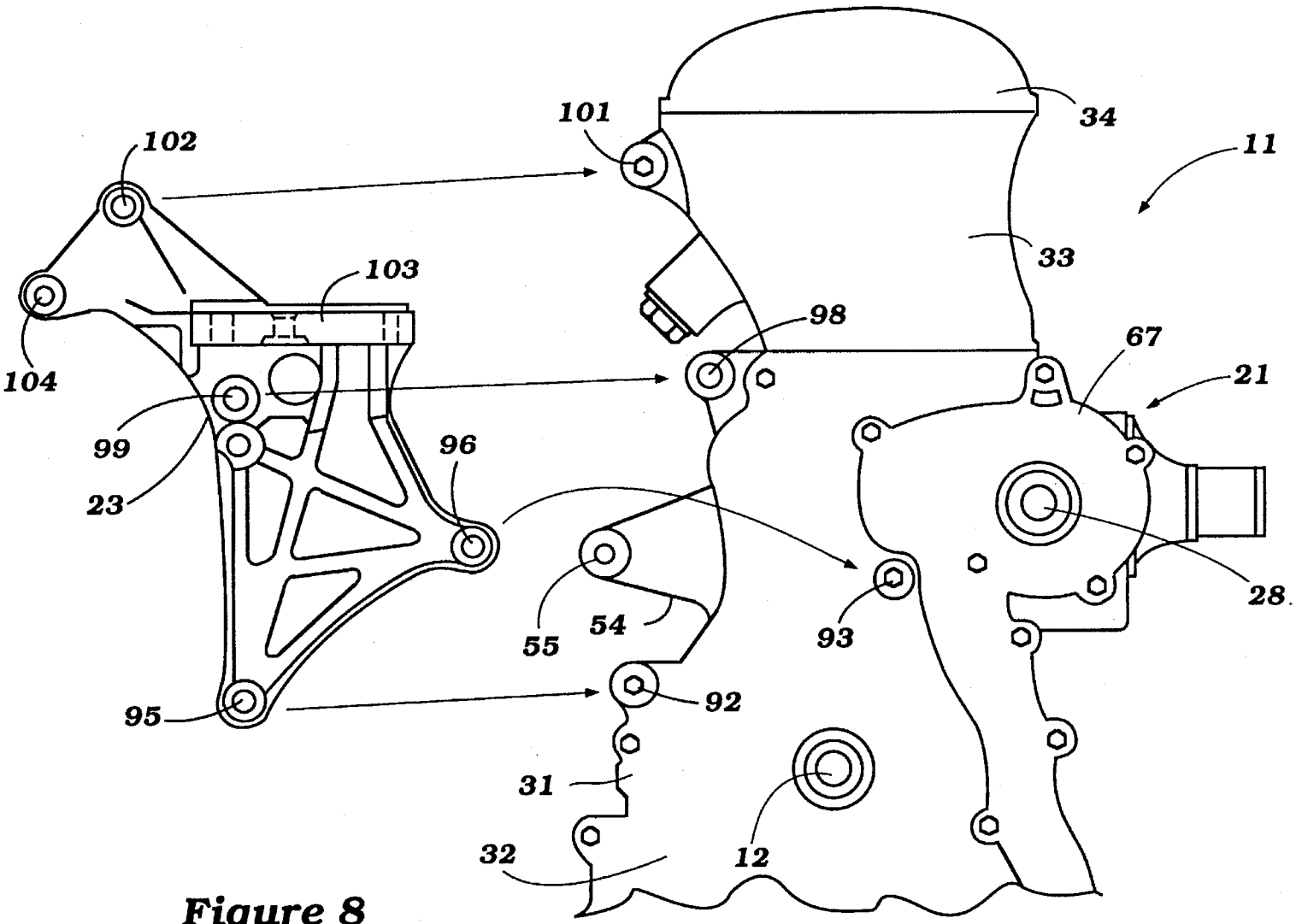
FIG. 8 is a front elevational view, in part similar to FIG. 2, but in partially exploded form, and shows how the alternator mounting bracket is affixed to the front face of the engine.

The mounting arrangement provided by the mounting bracket 23 for the alternator 24 and its attachment to the engine 11 will now be described by reference to FIG. 8, which is an exploded view showing the mounting bracket 23 disassembled from the engine. The timing case cover 32 is provided with a pair of openings 92 and 93 which extend through to the cylinder block 31 and are aligned with tapped openings formed therein, one of which appears in FIG. 4 and is identified by the reference numeral 94, this being the one aligned with the timing cover opening 93. The mounting bracket 23 is provided with bossed openings 95 and 96 that align with the openings 92 and 93, respectively, and which are held to the cylinder block by threaded fasteners 97 (FIG. 1).

The cylinder block forward face 42 is also provided with an opening 98 that is aligned with a corresponding opening 99 of the mounting bracket 23 and which receives a further threaded fastener 97 to affix the mounting bracket 23 in this area. Finally, the cylinder head 33 has a boss in which a tapped opening 101 is formed which is aligned with an opening 102 of the mounting bracket 23 and which receives a further threaded fastener 97 so as to complete the affixation of the mounting bracket 23 to the engine 11. The mounting bracket 23 further has a plate-like portion 103 that extends rearwardly and which permits it and the associated engine 11 to be affixed to the associated vehicle.

The mounting bracket 102 further has an opening 104 that aligns with a lug 105 formed on the alternator 24 so as to receive a threaded fastener 106 so as to affix the alternator 24 to the mounting bracket 23. One of the mountings for the alternator 24 provided for by either the opening 104 or the lug 54 of the cylinder block may be arcuate in shape so as to permit adjustment of the tension on the drive belt 14. Alternatively, drive belt tension may be adjusted by adjusting of the idler pulley 22 referred to.

Figure 9:
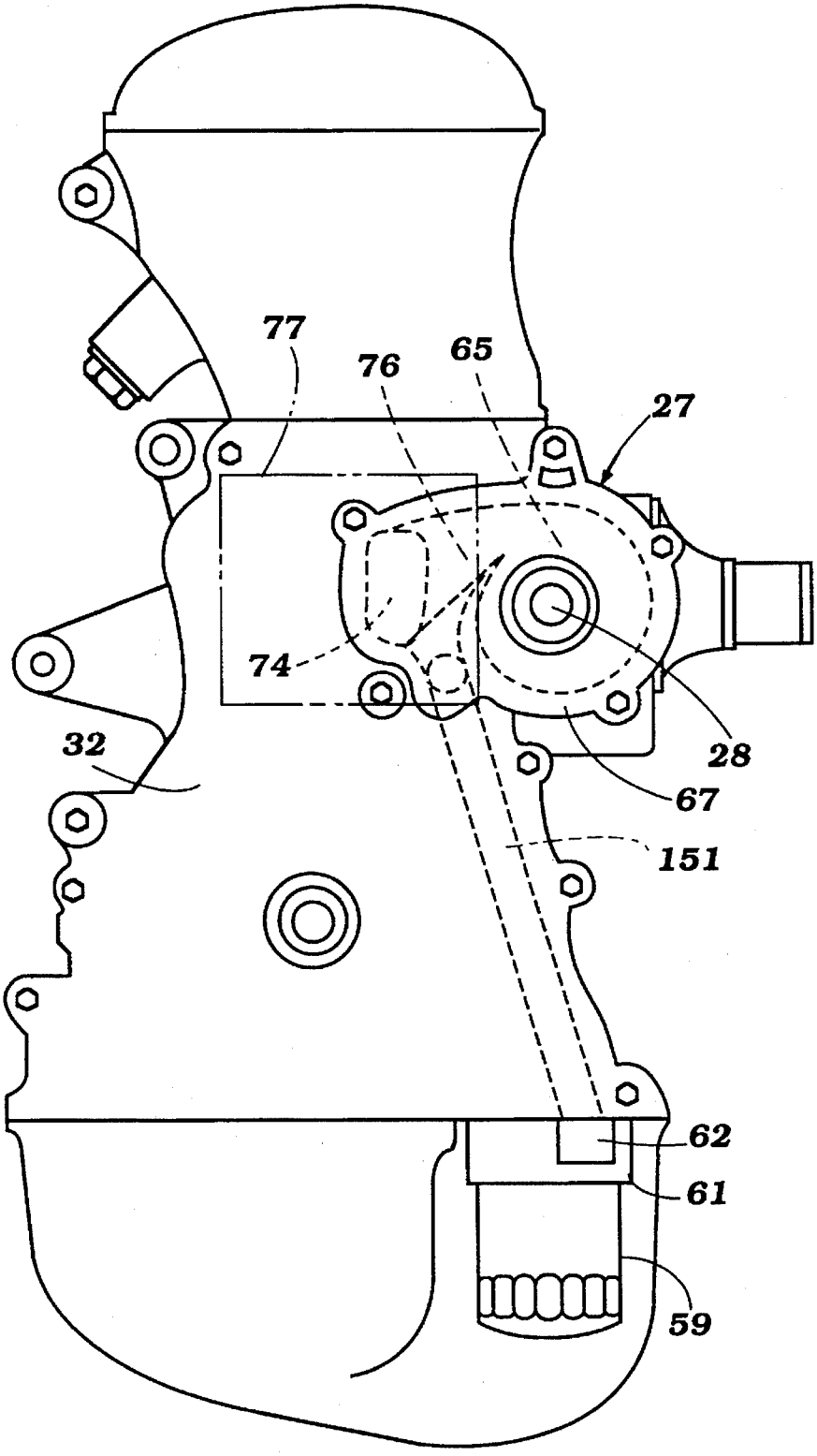
FIG. 9 is a front elevational view, in part similar to FIG. 2, and shows another embodiment of the invention.

In the embodiment of the invention as thus far described, the coolant passage for delivery coolant to the oil cooler 61 was formed at 78 by the timing case cover 32 and coolant pump cover 67. This necessitated the extension of the coolant pump cover 67 to the lower end of the cylinder block 31. FIG. 9 shows a first embodiment in which the use of such an extension of the coolant pump cover is not required. In this embodiment, a coolant passage 151 extends from the coolant pump discharge cavity 76 entirely within the timing case cover 32 to the cylinder block water inlet passage 79 that serves the oil cooler 61.

Figure 10:
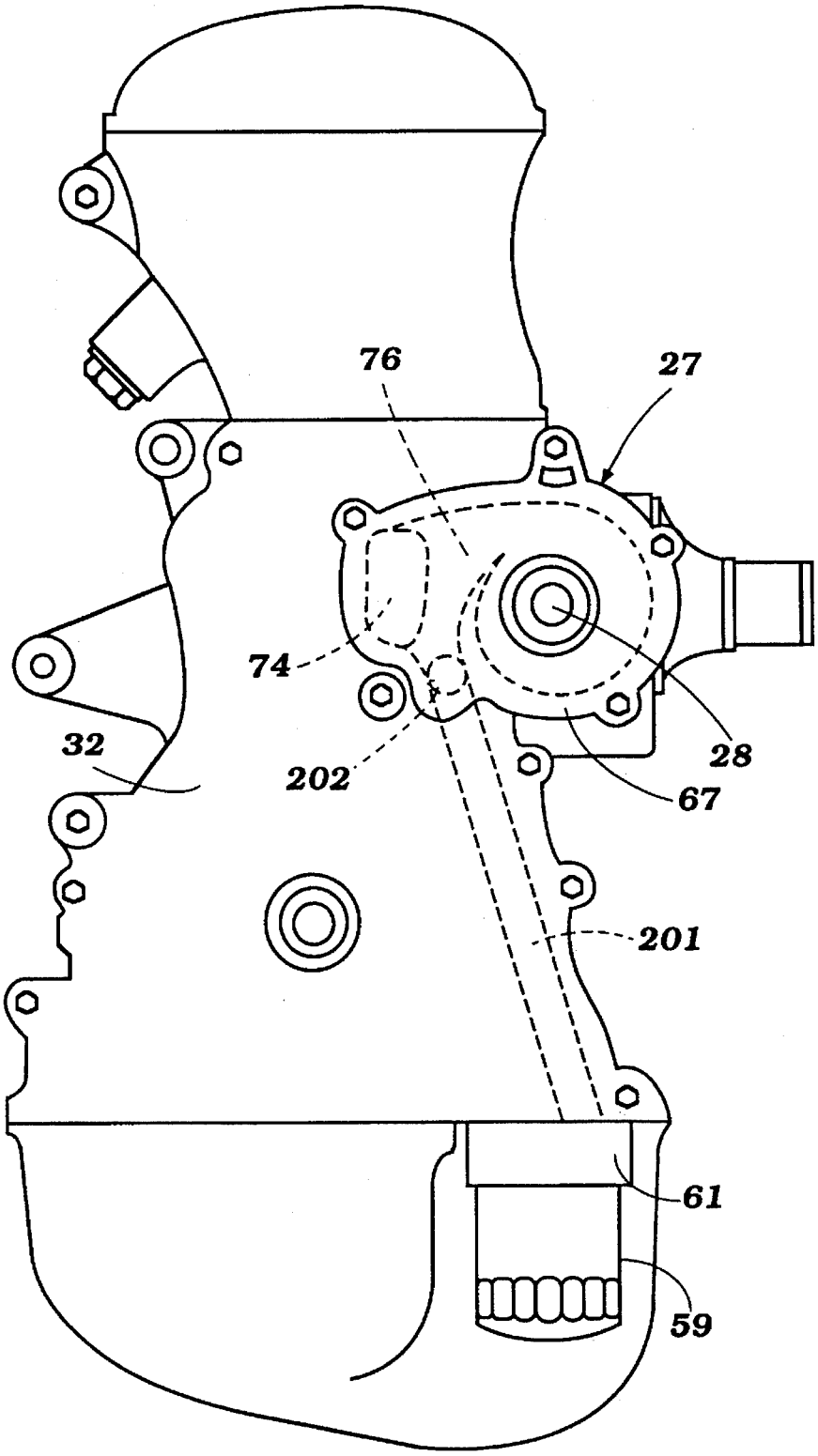
FIG. 10 is a front elevational view, in part similar to FIGS. 2 and 9, and shows yet another embodiment of the invention.

FIG. 10 shows another way in which this can be accomplished and in this embodiment, the cylinder block is formed with a passage 201 that extends downwardly to the oil cooler 61. In this case, the boss 62 is not required for the oil cooler 61. The upper end of the passage 201 communicates with a cross-passage 202 that extends through the front face of the cylinder block 31 and which cooperates with a corresponding passage formed in the timing case cover 32 which communicates with the coolant pump outlet passage 76.

It should be readily apparent that the described embodiments of the invention provide a very compact engine construction wherein the coolant pump is formed at least in part by the timing case cover and thus facilitates driving of a plurality of accessories from a common drive belt including the water pump. Of course, the foregoing description is that of preferred embodiments of the invention and various changes and modifications may be made without departing from the spirit and scope of the invention, as defined by the appended claims.

I claim:

1. An internal combustion engine comprised of a cylinder block having an end face, a cooling jacket for said engine formed at least in part in said cylinder block, a crankshaft journalled for rotation at a lower portion of said cylinder block, a camshaft journalled for rotation at an upper portion of said cylinder block, timing means disposed forwardly of said cylinder block end face for driving said camshaft from said crankshaft, a timing case cover affixed to said cylinder block end face and at least in part enclosing said timing means, and a coolant pump assembly for circulating liquid coolant for said engine formed at least in part by said timing case cover, said cylinder block end face forming a first passage for delivering coolant from said engine cooling jacket to said coolant pump and a second passage for returning coolant from the coolant pump to said engine cooling jacket.

2. An internal combustion engine as set forth in claim 1 wherein the coolant pump assembly comprises at least a cooling passage for delivering coolant to the engine formed at least in part in the timing case cover.

3. An internal combustion engine as set forth in claim 1 wherein the coolant pump includes an impeller housing formed in the timing case cover in which an impeller is journaled for rotation, said impeller having an impeller shaft extending through a coolant pump cover affixed to the timing case cover and driven by the engine independently of the timing means.

4. An internal combustion engine as set forth in claim 1 further including an oil cooler formed at the lower end of the cylinder block and further including coolant passage means for delivering coolant pumped by the coolant pump to said oil cooler.

5. An internal combustion engine as set forth in claim 1 wherein the end face of the cylinder block is bounded on its opposite sides by a pair of outstanding flanges having sealing surfaces lying in parallel but offset planes at different distances from said end face and to which the timing case cover is affixed.

6. An internal combustion engine as set forth in claim 5 wherein the coolant pump is formed on the side of the timing case cover adjacent the cylinder block that is disposed closest to the cylinder block end face.

7. An internal combustion engine as set forth in claim 6 further included an accessory mount fixed to the cylinder block and timing case cover on the side opposite the coolant pump and driven by the same timing belt as the coolant pump.

8. An internal combustion engine comprised of a cylinder block having an end face, a cooling jacket for said engine formed at least in part in said cylinder block, a crankshaft journalled for rotation at a lower portion of said cylinder block, a camshaft journalled for rotation at an upper portion of said cylinder block, timing means disposed forwardly of said cylinder block end face for driving said camshaft from said crankshaft, P timing case cover affixed to said cylinder block end face and at least in part enclosing said timing means, and a coolant pump assembly for circulating liquid coolant for said engine formed at least in part by said timing case cover, an oil cooler formed at the lower end of said cylinder block, and a coolant passage extending from said coolant pump to said oil cooler, said coolant passage being formed at least in part in said timing case cover.

9. An internal combustion engine as set forth in claim 8 wherein the oil cooler is formed at the base of the cylinder block and at least a part of the coolant passage for delivery coolant from the coolant pump to the oil cooler is formed also in the cylinder block.

10. An internal combustion engine comprised of a cylinder block having an end face, a crankshaft journalled for rotation at a lower portion of said cylinder block, a camshaft journalled for rotation at an upper portion of said cylinder block, timing means disposed forwardly of said cylinder block end face for driving said camshaft from said crankshaft, a timing case cover affixed to said cylinder block end face and at least in part enclosing said timing means, a coolant pump assembly for circulating liquid coolant for said engine formed at least in part by said timing case cover, said end face of said cylinder block being bounded on its opposite sides by a pair of outstanding flanges having sealing surfaces lying in parallel but offset planes at different distances from said end face and to which the timing case cover is affixed, said coolant pump being formed on the side of said timing case cover adjacent the cylinder block flange that is disposed closest to said cylinder block end face.

11. An internal combustion engine as set forth in claim 10 further included an accessory mount fixed to the cylinder block and timing case cover on the side opposite the coolant pump and driven by the same drive belt as the coolant pump.

12. An internal combustion engine as set forth in claim 10 wherein the engine is provided with a cam driving shaft disposed below the camshaft and closer to one side of the cylinder than the other, the timing means comprises a first chain driving said cam driving shaft from the crankshaft and a second chain driving the camshaft from said cam driving shaft.

13. An internal combustion engine as set forth in claim 12 wherein the cam driving shaft is offset to one side of the crankshaft.

14. An internal combustion engine as set forth in claim 13 further including a tensioner for the first timing chain and disposed on the side of the engine opposite the side to which the cam driving shaft is offset.

15. An internal combustion engine as set forth in claim 12 further including a second camshaft journaled for rotation above the cylinder block on the other side of the cylinder, said cam driving shaft being positioned beneath the first-mentioned camshaft and driving both of the camshafts through a second chain.

16. An internal combustion engine as set forth in claim 15 further including a tensioner for the first timing chain and disposed on the side of the engine opposite the side to which the cam driving shaft is offset.

17. An internal combustion engine as set forth in claim 16 further including a tensioner for tensioning the second chain.

18. An internal combustion engine as set forth in claim 17 wherein the second camshaft operates more valves per cylinder than the first camshaft.

19. An internal combustion engine as set forth in claim 17 wherein the second tensioner is disposed contiguous to the second camshaft.

* * * * *